US010889778B2

(12) United States Patent
Kodama et al.

(10) Patent No.: US 10,889,778 B2
(45) Date of Patent: Jan. 12, 2021

(54) MANUFACTURING METHOD OF LUBRICANT COMPOSITION AND LUBRICANT COMPOSITION

(71) Applicant: FUJIFILM Corporation, Tokyo (JP)

(72) Inventors: Kunihiko Kodama, Ashigarakami-gun (JP); Yuta Shigenoi, Ashigarakami-gun (JP)

(73) Assignee: FUJIFILM Cornoration, Tokyo (JP)

( * ) Notice: Subject to any disclaimer, the term of this patent is extended or adjusted under 35 U.S.C. 154(b) by 29 days.

(21) Appl. No.: 16/281,267

(22) Filed: Feb. 21, 2019

(65) Prior Publication Data

US 2019/0185779 A1 Jun. 20, 2019

Related U.S. Application Data

(63) Continuation of application No. PCT/JP2017/023670, filed on Jun. 28, 2017.

(30) Foreign Application Priority Data

Aug. 31, 2016 (JP) ..... 2016-169865

(51) Int. Cl.

| | |
|---|---|
| ***C10M 129/78*** | (2006.01) |
| ***C10M 133/08*** | (2006.01) |
| ***C10N 20/02*** | (2006.01) |
| ***C10N 20/04*** | (2006.01) |
| ***C10N 30/06*** | (2006.01) |

(52) U.S. Cl.

CPC ..... *C10M 129/78* (2013.01); *C10M 133/08* (2013.01); *C10M 2203/003* (2013.01); *C10M 2203/1006* (2013.01); *C10M 2207/30* (2013.01); *C10M 2207/301* (2013.01); *C10M 2209/102* (2013.01); *C10M 2215/082* (2013.01); *C10M 2215/28* (2013.01); *C10M 2223/045* (2013.01); *C10N 2020/02* (2013.01); *C10N 2020/04* (2013.01); *C10N 2030/06* (2013.01)

(58) Field of Classification Search

CPC ..... C10M 137/04; C10M 129/78; C10M 133/08; C10M 2203/003; C10M 2203/1006; C10M 2207/30; C10M 2207/301; C10M 2209/102; C10M 2215/082; C10M 2223/045; C10N 2020/02; C10N 2020/04; C10N 2030/06

See application file for complete search history.

(56) References Cited

U.S. PATENT DOCUMENTS

| | | | | |
|---|---|---|---|---|
| 5,922,658 | A | 7/1999 | Duncan et al. | |
| 5,994,278 | A | 11/1999 | Duncan et al. | |
| 7,820,602 | B2 * | 10/2010 | Ravichandran | C07F 11/005 508/364 |
| 2007/0254818 | A1 * | 11/2007 | Oldfield | C10M 145/22 508/384 |
| 2011/0269655 | A1 * | 11/2011 | Randles | C10M 145/22 508/455 |
| 2012/0184474 | A1 | 7/2012 | Kawata et al. | |
| 2013/0196888 | A1 * | 8/2013 | Truong-Dinh | C10M 161/00 508/364 |
| 2015/0113864 | A1 * | 4/2015 | Walter | C10L 10/04 44/398 |
| 2017/0096615 | A1 * | 4/2017 | Scanlon | C10M 141/12 |

FOREIGN PATENT DOCUMENTS

| | | | |
|---|---|---|---|
| JP | 2001-500549 | A | 1/2001 |
| JP | 2001-501989 | A | 2/2001 |
| JP | 2001-507334 | A | 6/2001 |
| JP | 2002-097482 | A | 4/2002 |
| JP | 2002-530476 | A | 9/2002 |
| JP | 2005-154726 | A | 6/2005 |
| JP | 2005-213377 | A | 8/2005 |
| JP | 2005-232434 | A | 9/2005 |
| JP | 2005-232470 | A | 9/2005 |
| JP | 2011-089106 | A | 5/2011 |
| JP | 2012-102235 | A | 5/2012 |

OTHER PUBLICATIONS

International Search Report dated Aug. 15, 2017 issued by the International Searching Authority in PCT/JP2017/023670.

Written Opinion dated Aug. 15, 2017 issued by the International Searching Authority in PCT/JP2017/023670.

International Preliminary Report on Patentability dated Nov. 13, 2017 issued by the International Bureau in PCT/JP2017/023670.

* cited by examiner

*Primary Examiner* — James C Goloboy

(74) *Attorney, Agent, or Firm* — Sughrue Mion, PLLC

(57) ABSTRACT

A manufacturing method of a lubricant composition includes mixing a composite ester A that contains polyester obtained by condensing trihydric or more polyhydric alcohol a1, a divalent or more polyvalent carboxylic acid a2, and at least one selected from monohydric alcohol a3 or a monovalent carboxylic acid a4, with a compound B having a hydroxyl number of greater than 50 mgKOH/g. A lubricant composition contains the composite ester A and the compound B.

12 Claims, No Drawings

MANUFACTURING METHOD OF LUBRICANT COMPOSITION AND LUBRICANT COMPOSITION

CROSS-REFERENCE TO RELATED APPLICATIONS

This application is a Continuation of PCT International Application No. PCT/JP2017/023670 filed on Jun. 28, 2017, which claims priority under 35 U.S.C § 119(a) to Japanese Patent Application No. 2016-169865 filed on Aug. 31, 2016. Each of the above application(s) is hereby expressly incorporated by reference, in its entirety, into the present application.

BACKGROUND OF THE INVENTION

1. Field of the Invention

The present invention relates to a manufacturing method of a lubricant composition and a lubricant composition. More specifically, the present invention relates to a manufacturing method of a lubricant composition which contains specific composite ester and a specific compound, and which is capable of exerting excellent lubrication properties even in rigorous conditions such as a high temperature and/or a high pressure, and the lubricant composition.

2. Description of the Related Art

In general, a lubricant contains base oil and various additives. Examples of the base oil include mineral oil obtained from crude oil, ester-based oil which is chemically synthesized, fluorine oil, poly a olefin-based oil, and the like. Among them, the ester-based oil is suitably used in a jet plane, automobile engine oil, grease, and the like from the viewpoint of a low pour point, a high viscosity index, a high ignition point, excellent lubrication properties, biodegradability, and the like.

As the ester-based oil, various esters such as monoester obtained from a reaction between an aliphatic moncarboxylic acid and monohydric alcohol; diester obtained from a reaction between an aliphatic dicarboxylic acid and monohydric alcohol; ester obtained from a reaction between polyhydric alcohol and an aliphatic carboxylic acid; and composite ester obtained from a reaction between polyol, a polybasic acid, and an aliphatic monocarboxylic acid have been disclosed (JP2002-097482A, JP2005-154726A, JP2005-232434A, JP2005-213377A, JP2005-232470A, JP2001-501989A, JP2001-500549A, JP2001-507334A, and JP2011-089106A).

SUMMARY OF THE INVENTION

Recently, there is a greater demand for saving of resources and reduction of carbon dioxide emissions, and thus there is a demand for further improvement of lubrication properties in a lubricant. However, in a case of using a lubricant in the related art, it cannot be said that a sliding member is made to sufficiently have low friction in rigorous conditions such as a high pressure and/or a high temperature, and even in a case of using a lubricant that contains the above-mentioned ester-based oil, there is a demand for further reduction in friction coefficient.

In addition, in a case where a lubricant is used in rigorous conditions such as a high pressure and/or a high temperature, it is important to achieve both suppression of abrasion and suppression of seizure simultaneously with reduction of friction. However, in lubricants and lubricants containing ester-based oil in the related art, both abrasion resistance and seizure resistance in rigorous conditions such as a high pressure and/or a high temperature are not achieved, and there is a demand for improvements.

An object of the present invention is to provide a lubricant composition which is capable of reducing friction even in rigorous conditions such as a high temperature and/or a high pressure, and which has both high abrasion resistance and seizure resistance.

As a result of various studies of the present inventors for attaining the object described above, it has been found that in a case where composite ester A that contains polyester obtained by condensing trihydric or more polyhydric alcohol a1, a divalent or more polyvalent carboxylic acid a2, and at least one selected from monohydric alcohol a3 or a monovalent carboxylic acid a4 is mixed with a compound B having a hydroxyl number of greater than 50 mgKOH/g, to form a lubricant composition, a lubricant composition which is capable of reducing friction even in rigorous conditions such as a high temperature and/or a high pressure, and which has both abrasion resistance and seizure resistance is obtained.

Specifically, the present invention has the following constitution.

[1] A manufacturing method of a lubricant composition, comprising:

mixing a composite ester A that contains polyester obtained by condensing trihydric or more polyhydric alcohol a1, a divalent or more polyvalent carboxylic acid a2, and at least one selected from the group consisting of monohydric alcohol a3 and a monovalent carboxylic acid a4, with a compound B represented by any one of General Formulae 1 to 3 and having a hydroxyl number of greater than 50 mgKOH/g, General Formula 1

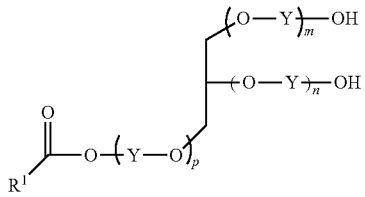

General Formula 2

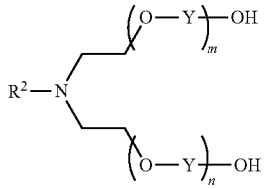

General Formula 3

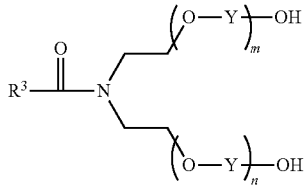

in General Formulae 1 to 3, $R^1$ to $R^3$ each independently represent a hydrocarbon group having 4 to 30 carbon atoms; Y represents an alkylene group having 2 to 4 carbon atoms, and, in a case where a plurality of Y's are present in one molecule, the plurality of Y's may be the same or different from each other; and m, n, and p each independently represent an integer of 0 to 20.

[2] The manufacturing method of a lubricant composition according to [1], in which the polyvalent carboxylic acid a2 is a polyvalent carboxylic acid having greater than or equal to 36 carbon atoms.

[3] The manufacturing method of a lubricant composition according to [1] or [2], in which the monohydric alcohol a3 has an oxyalkylene structure.

[4] The manufacturing method of a lubricant composition according to any one of [1] to [3], in which the compound B has at least one structure selected from the group consisting of an ester structure, an amine structure, or an amide structure.

[5] The manufacturing method of a lubricant composition according to any one of [1] to [4], further comprising:

a step of adding a compound that contains at least one atom selected from the group consisting of molybdenum, zinc, phosphorus, or sulfur.

[6] The manufacturing method of a lubricant composition according to any one of [1] to [5], in which the composite ester A and the compound B are mixed so that a mass ratio of the composite ester A to the compound B is 100:1 to 1:50.

[7] The manufacturing method of a lubricant composition according to any one of [1] to [6], in which the compound B has a hydroxyl number of greater than 100 mgKOH/g.

In addition, the manufacturing method of a lubricant composition according to any one of [1] to [7], in the General Formulae 1 to 3, Y represents an alkylene group having 2 to 4 carbon atoms, and m and n each independently represent an integer of 0 to 5.

[8] A lubricant composition, comprising:

a composite ester A that contains polyester obtained by condensing trihydric or more polyhydric alcohol a1, a divalent or more polyvalent carboxylic acid a2, and at least one selected from the group consisting of monohydric alcohol a3 and a monovalent carboxylic acid a4; and a compound B represented by any one of General Formulae 1 to 3 and having a hydroxyl number of greater than 50 mgKOH/g, General Formula 1

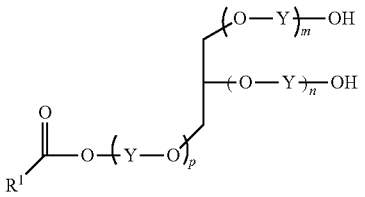

General Formula 2

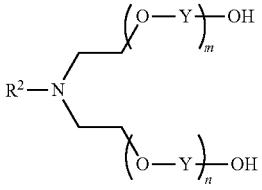

-continued

General Formula 3

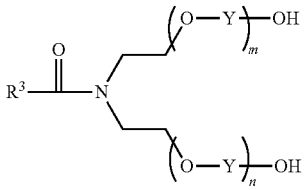

in General Formulae 1 to 3, $R^1$ to $R^3$ each independently represent a hydrocarbon group having 4 to 30 carbon atoms; Y represents an alkylene group having 2 to 4 carbon atoms, and, in a case where a plurality of Y's are present in one molecule, the plurality of Y's may be the same or different from each other; and m, n, and p each independently represent an integer of 0 to 20.

[9] The lubricant composition according to [8], in which the polyvalent carboxylic acid a2 is a polyvalent carboxylic acid having greater than or equal to 36 carbon atoms.

[10] The lubricant composition according to [8] or [9], in which the monohydric alcohol a3 has an oxyalkylene structure.

[11] The lubricant composition according to any one of [8] to [10], further comprising:

a compound that contains at least one atom selected from the group consisting of molybdenum, zinc, phosphorus, and sulfur.

[12] The lubricant composition according to any one of [8] to [11], in which the compound B has a molecular weight of less than or equal to 1,000.

[13] The lubricant composition according to any one of [8] to [12], in which the compound B has at least one structure selected from the group consisting of an ester structure, an amine structure, and an amide structure.

[14] The lubricant composition according to any one of [8] to [13], in which a mass ratio of the composite ester A to the compound B is 100:1 to 1:50.

In addition, The lubricant composition according to any one of [8] to [14], in General Formulae 1 to 3, Y represents an alkylene group having 2 to 4 carbon atoms, and m and n each independently represent an integer of 0 to 5.

According to the present invention, it is possible to obtain a lubricant composition capable of reducing friction even in rigorous conditions such as a high temperature and/or a high pressure. Furthermore, according to the present invention, it is possible to obtain a lubricant composition having both abrasion resistance and seizure resistance even in rigorous conditions such as a high temperature and/or a high pressure.

DESCRIPTION OF THE PREFERRED EMBODIMENTS

Hereinafter, the present invention will be described in detail. The following description of configuration requirements are based on representative embodiments or specific examples, but the present invention is not limited to the embodiments. Furthermore, herein, a numerical range represented by using "to" indicates a range including the numerical values before and after "to" as the lower limit value and the upper limit value.

(Manufacturing Method of Lubricant Composition)

The manufacturing method of a lubricant composition of the embodiment of the present invention includes a step of mixing composite ester A that contains polyester obtained by condensing trihydric or more polyhydric alcohol a1, a divalent or more polyvalent carboxylic acid a2, and at least one selected from monohydric alcohol a3 or a monovalent carboxylic acid a4, with a compound B having a hydroxyl number of greater than 50 mgKOH/g. In the present invention, the composite ester A is mixed with the compound B having a predetermined hydroxyl number, so that a lubricant composition containing the composite ester A and the compound B is obtained. Such a lubricant composition is capable of reducing friction even in rigorous conditions such as a high temperature and/or a high pressure. In addition, such a lubricant composition is capable of exerting abrasion resistance and seizure resistance even in rigorous conditions such as a high temperature and/or a high pressure. The fact that the lubricant composition is capable of exerting the effects described above in rigorous conditions such as a high temperature and/or a high pressure indicates that the effects described above can naturally be exerted even under normal conditions (a normal temperature and a normal pressure).

In the present specification, lubrication properties can be evaluated by friction coefficient, abrasion properties, and seizure properties. Excellent lubrication properties mean that a sliding member has a low friction coefficient, and is excellent in abrasion resistance and seizure resistance. Seizure properties of a lubricant composition can be evaluated under the conditions specified in ASTM D3233-A by using the Falex test method, and a larger value in seizure load indicates excellent seizure resistance.

<Composite Ester A>

The composite ester A contains polyester obtained by condensing trihydric or more polyhydric alcohol a1, a divalent or more polyvalent carboxylic acid a2, and at least one selected from monohydric alcohol a3 or a monovalent carboxylic acid a4. In the at least one selected from the monohydric alcohol a3 or the monovalent carboxylic acid a4, it is preferable to use the monohydric alcohol a3. That is, it is preferable that the composite ester A contains polyester obtained by condensing at least the trihydric or more polyhydric alcohol a1, the divalent or more polyvalent carboxylic acid a2, and the monohydric alcohol a3.

<Trihydric or more Polyhydric Alcohol a1>

Examples of the trihydric or more polyhydric alcohol a1 can include compounds containing three or more of alcoholic hydroxyl groups and/or phenolic hydroxyl groups in a molecule. Among them, the trihydric or more polyhydric alcohol a1 is preferably a compound containing three or more alcoholic hydroxyl groups, and is more preferably a compound having 3 to 6 alcoholic hydroxyl groups.

The trihydric or more polyhydric alcohol a1 is preferably an alcohol represented by General Formula (a1-1a).

$$Z\text{-}(\text{-}OH)_{m1} \qquad \text{General Formula (a1-1a)}$$

In General Formula (a1-1a), Z represents an m1-valent linking group, and m1 represents an integer of greater than or equal to 3.

The alcohol represented by General Formula (a1-1a) is an m1-hydric alcohol.

In General Formula (a1-1a), Z is an m1-valent linking group, and, in other words, Z indicates a polyhydric alcohol mother nucleus formed by removing m1 hydroxyl groups from m1-hydric alcohol.

Z is an m1-valent linking group that contains at least one trivalent or more linking group. The trivalent or more linking group is not particularly limited, and preferable examples thereof can include a trivalent linking group containing a tertiary carbon atom and a quaternary carbon atom.

As the trivalent linking group containing a tertiary carbon atom, the following structure is preferable, and $R^c$ in the following structure represents a hydrogen atom or a substituent. In addition, * represents a bonding position with respect to a linking chain.

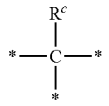

The quaternary carbon atom has the following structure.

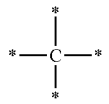

Z preferably has a structure in which an alkylene group, an arylene group, and a plurality of these are single-bonded, or a structure in which an alkylene group, an arylene group, and a plurality of these are bonded by a divalent linking group (preferably, —O—, —C(=O)—, —OC(=)O—, —S—, —$SO_2$—, —C(=O)—, —C(=O)$NR^b$— ($R^b$ is a hydrogen atom, an alkyl group, or an aryl group)) or a trivalent or more linking group, and is an m1-valent linking group that contains at least one trivalent or more linking group. Z may have another substituent.

Among them, Z is preferably a residue obtained by removing a hydroxyl group from each of preferable examples of the trihydric or more polyhydric alcohol as described later.

It is sufficient that m1 is an integer of greater than or equal to 3. m1 is preferably 3 to 6, and is more preferably 3 or 4.

Specific examples of the trihydric or more polyhydric alcohol can include trihydric alcohol such as glycerin, 1,2,3-butanetriol, 1,2,4-butanetriol, 1,2,3-pentanetriol, 1,2,4-pentanetriol, 2-methyl-1,2,3-propanetriol, 2-methyl-2,3,4-butanetriol, 2-ethyl-1,2,3-butanetriol, 2,3,4-pentanetriol, 3-methylpentane-1,3,5-triol, 2,4-dimethyl-2,3,4-pentanetriol, 2,3,4-hexanetriol, 4-propyl-3,4,5-heptanetriol, 1,3,5-cyclohexanetriol, pentamethyl glycerin, trimethylol ethane, and trimethylol propane;

tetrahydric alcohol such as 1,2,3,4-butanetetraol, pentaerythritol, diglycerin, sorbitan, ribose, arabinose, xylose, lyxose, ditrimethylol ethane, and ditrimethylol propane;

pentahydric alcohol such as arabitol, xylitol, glucose, fructose, galactose, mannose, allose, gulose, idose, and talose;

hexahydric alcohol such as dipentaerythritol, sorbitol, galactitol, mannitol, alitol, iditol, talitol, inositol, and quercitol; and octahydric alcohol such as tripentaerythritol.

Among them, the trimethylol ethane, the trimethylol propane, glycerol, the pentaerythritol, the ditrimethylol ethane, the ditrimethylol propane, the dipentaerythritol, and the tripentaerythritol are more preferable, with the trimethylol propane, the trimethylol ethane, the ditrimethylol propane, the glycerol, the pentaerythritol, and the dipentaerythritol being particularly preferable.

As the trihydric or more polyhydric alcohol a1, a compound (a compound having an alkyleneoxy structure) obtained by adding alkylene oxide to at least one hydroxyl group possessed by the trihydric or more polyhydric alcohol as described above can also be preferably used. As the alkylene oxide added, ethylene oxide, propylene oxide, butylene oxide, and a plurality of combinations thereof are preferable, with the ethylene oxide and the propylene oxide being more preferable. In this case, the trihydric or more polyhydric alcohol a1 is preferably a compound obtained by adding alkylene oxides each independently to all hydroxyl groups possessed by the trihydric or more polyhydric alcohol.

The number of alkylene oxides (oxyalkylene structures) contained in the trihydric or more polyhydric alcohol a1 is, on average, preferably 1 to 200, and is more preferably 1 to 100. The more preferable number of the alkylene oxides added is a number which is, on average, 1 to 20 times, is more preferably 2 to 10 times, and is particularly preferably 3 to 7 times, with respect to the number of hydroxyl groups in the trihydric or more polyhydric alcohol a1.

The trihydric or more polyhydric alcohol a1 having an oxyalkylene structure is preferably a compound represented by General Formula (a1-1b).

$$Z\left[-\left(O-R^{11}\right)_{n1}\right]-OH$$ General Formula (a1-1b)

In General Formula (a1-1b), Z represents an m1-valent linking group, m1 represents an integer of greater than or equal to 3, $R^{11}$ represents an alkylene group, and n1 represents an integer of 1 to 100.

Z and m1 in General Formula (a1-1b) have the same meanings as Z and m1 in General Formula (a1-1a), respectively. A preferable Z is a residue obtained by removing a hydroxyl group from each of the preferable examples of the trihydric or more polyhydric alcohol as described above.

$R^{11}$ is an alkylene group, and preferably an ethylene group, a propylene group, and a butylene group, with the ethylene group and the propylene group being more preferable. A plurality of $R^{11}$'s may be the same or different from each other.

n1 is preferably an integer of 1 to 100, is more preferably 1 to 20, is even more preferably 2 to 10, and is particularly preferably 3 to 7. A plurality of n1's may be the same or different from each other.

Preferable specific examples of the trihydric or more polyhydric alcohol a1 which can be used in the present invention are shown below. However, the present invention is not limited thereto.

a1-a

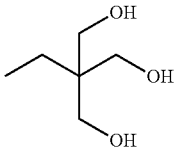

a1-b

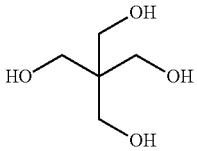

-continued a1-c

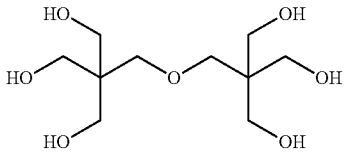

a1-d

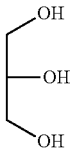

a1-e

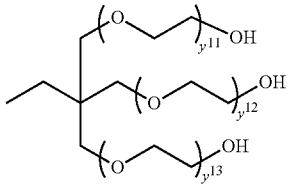

a1-f

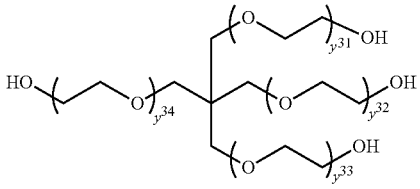

In the compound a1-e, $y^{11}$ to $y^{13}$ each independently represent an integer of greater than or equal to 0, in which at least one thereof represents an integer of greater than or equal to 1, and an average value thereof is 1 to 10. As the a1-e used in Examples as described later, a compound in which an average value of $y^{11}$ to $y^{13}$ is 3 was used.

$y^{31}$ to $y^{34}$ each independently represent an integer of greater than or equal to 0, in which at least one thereof represents an integer of greater than or equal to 1, and an average value thereof is 1 to 10.

<Divalent or More Polyvalent Carboxylic Acid a2>

The divalent or more polyvalent carboxylic acid a2 is a compound having two or more carboxyl groups or carboxylic acid precursor structures. The divalent or more polyvalent carboxylic acid a2 is compound that preferably has 2 to 4 carboxyl groups, more preferably has 2 or 3 carboxyl groups, and even more preferably has 2 carboxyl groups. Hereinafter, the divalent or more polyvalent carboxylic acid a2 may be referred to simply as "polyvalent carboxylic acid a2". Here, the carboxylic acid precursor structure represents a structure capable of reacting with the trihydric or more polyhydric alcohol a1 or the monohydric alcohol a3 to form an ester bond. As the carboxylic acid precursor, carboxylic acid halide, carboxylic acid ester (preferably, methyl ester and ethyl ester), carboxylic acid anhydride, and mixed anhydride of a carboxylic acid and another acid (preferably, a sulfonic acid such as methanesulfonic acid and toluenesulfonic acid, and a substituted carboxylic acid such as trifluoroacetic acid) can be preferably exemplified. Hereinafter, the carboxylic acid precursor is also included in the detailed description of the polyvalent carboxylic acid a2.

The carboxyl group in the polyvalent carboxylic acid a2 molecule is linked with chained or cyclic divalent or more aliphatic hydrocarbon or aromatic hydrocarbon. One or more carbon atoms that are not adjacent to each other in carbon atoms of the aliphatic hydrocarbon or aromatic hydrocarbon linking group may be substituted with an oxygen atom. In addition, the aliphatic hydrocarbon or aromatic hydrocarbon linking group may have a substituent, and, in this case, the substituent is preferably a halogen atom, an alkyl group, and an alkenyl group, with the alkyl group being more preferable.

The number of carbon atoms of the polyvalent carboxylic acid a2 is preferably greater than or equal to 4, is more preferably greater than or equal to 10, is even more preferably greater than or equal to 18, is still more preferably greater than or equal to 22, is still more preferably greater than or equal to 26, and is still more preferably greater than or equal to 36. In addition, the number of carbon atoms of the polyvalent carboxylic acid a2 is preferably less than or equal to 70, is more preferably less than or equal to 66, and is even more preferably less than or equal to 59. In the present invention, the number of carbon atoms of the polyvalent carboxylic acid a2 represents the number of carbon atoms which also includes a carbon atom constituting the carboxyl group. In such a manner, by setting the number of carbon atoms of the polyvalent carboxylic acid a2 to be in the range described above, it is possible to increase lubrication properties of the lubricant composition, and, in particular, it is possible to reduce friction even in rigorous conditions such as a high temperature and/or a high pressure.

Examples of the polyvalent carboxylic acid a2 which can be used in the present invention can include a terephthalic acid, a phthalic acid, a malonic acid, a succinic acid, a glutaric acid, an adipic acid, a suberic acid, an azelaic acid, a sebacic acid, a dodecanedioic acid, a trimellitic acid, a dimer acid (a dimer of an unsaturated carboxylic acid having 18 carbon atoms), a hydrogenated product of a dimer acid, a trimer acid (a trimer of an unsaturated carboxylic acid having 18 carbon atoms), and a dimer of an unsaturated carboxylic acid having 22 carbon atoms (for example, a dimer of an erucic acid). Among them, it is preferable to use the dimer acid, the hydrogenated product of a dimer acid, the trimer acid, and the dimer of an unsaturated carboxylic acid having 22 carbon atoms, and it is more preferable to use the dimer acid, the hydrogenated product of a dimer acid, and the dimer of an unsaturated carboxylic acid having 22 carbon atoms. From the viewpoint of lubrication properties in rigorous conditions such as a high temperature and/or a high pressure, and solubility in base oil, it is preferable to use the above compound as the polyvalent carboxylic acid a2.

Here, the dimer acid refers to a compound that contains, as a main component, an aliphatic or alicyclic dicarboxylic acid generated by dimerizing an unsaturated fatty acid (in general, the number of carbon atoms is 18) according to polymerization, a DIELS-ALDER reaction, or the like. Herein, the dimer acid refers to a compound most of which is a dimer composed of an aliphatic or alicyclic dicarboxylic acid and in which a trimer, a monomer, or the like is contained in an amount of several mol % to several tens of mol %. Specifically, a content of the dicarboxylic acid component in the dimer acid is preferably greater than or equal to 75% by mass, is more preferably greater than or equal to 80% by mass, is even more preferably greater than or equal to 90% by mass, and is particularly preferably greater than or equal to 95% by mass. In addition, a compound having a trimer as a main component is defined as a trimer acid, and, in this case, a dimer, a monomer, or the like is contained in an amount of several % by mol to several tens of % by mol.

Specific examples of the dimer acid include TSUNODYME (Registered Trademark) 205, 216, 228, and 395, manufactured by TSUNO CO., LTD., and specific examples of the trimer acid include TSUNODYME 345. As the dimer acid or the trimer acid, alternatively, products of COGNIS or UNIQEMA may be used.

Specific examples of the polyvalent carboxylic acid a2 which can be used in the present invention are shown below. However, the present invention is not limited thereto.

CA-1

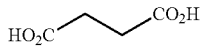

CA-2

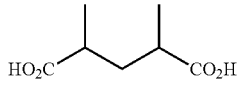

CA-3

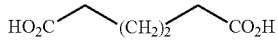

CA-4

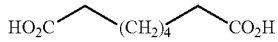

CA-5

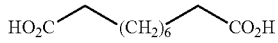

CA-6

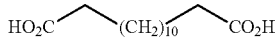

CA-7

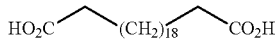

CA-8

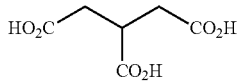

CA-9

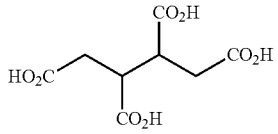

CA-10

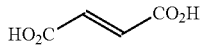

CA-11

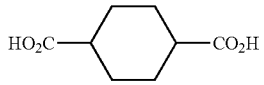

CA-12

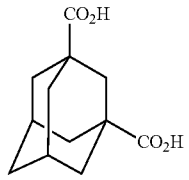

CA-13

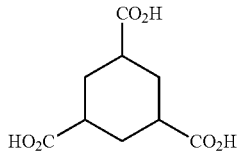

-continued

CA-14

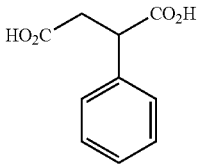

CA-15

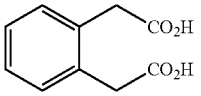

CA-16

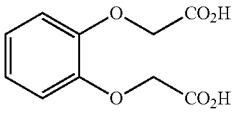

CA-17

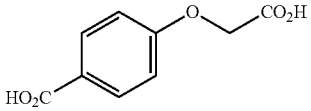

CA-18

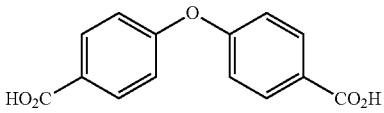

CA-19

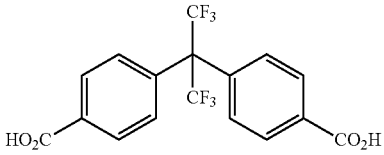

CA-20

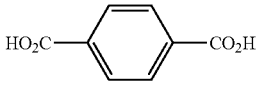

CA-21

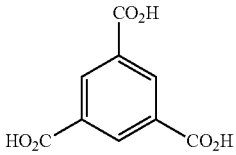

CA-22

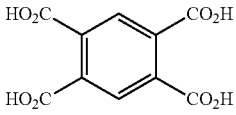

CA-23

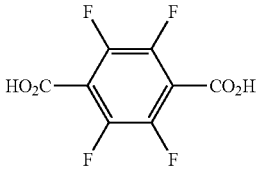

CA-24

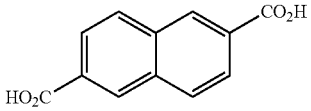

-continued

CA-25

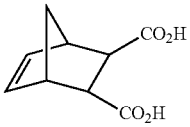

CA-26

$C_{34}H_{62}(COOH)_2$
Dimer acid

CA-27

$C_{51}H_{93}(COOH)_3$
Trimer acid

CA-28

$C_{42}H_{82}(COOH)_2$
C22 unsaturated carboxylic acid dimer

<Monohydric Alcohol a3>

The monohydric alcohol a3 is a compound containing one hydroxyl group in one molecule. The monohydric alcohol a3 is represented by R—OH. R is a monovalent organic group, and is preferably a monovalent aliphatic, alicyclic, or aromatic cyclic group. One or more carbon atoms that are not adjacent to each other in carbon atoms in R may be substituted with an oxygen atom. In addition, R may have a substituent, and a hydrogen atom in R may be substituted with a halogen atom. It is sufficient that the number of carbon atoms of R is greater than or equal to 1. The number of carbon atoms is preferably greater than or equal to 4, is more preferably greater than or equal to 6, is particularly preferably greater than or equal to 8, and is even more preferably greater than or equal to 10. By setting the number of carbon atoms of the monohydric alcohol to be in the range described above, solubility of the lubricant composition in various base oil is improved, and friction is easily reduced. Furthermore, by setting the number of carbon atoms of the monohydric alcohol to be in the range described above, it is possible to suppress volatilization of the monohydric alcohol during a condensation reaction.

The monohydric alcohol a3 preferably has a branched alkyl structure. By using such monohydric alcohol a3, it is possible to further increase lubrication properties of the lubricant composition in rigorous conditions such as a high temperature and/or a high pressure.

In addition, it is preferable that the monohydric alcohol a3 has an oxyalkylene structure. By using the monohydric alcohol a3 having an oxyalkylene structure, the lubricant composition easily exerts excellent lubrication properties even in rigorous conditions such as a high temperature and/or a high pressure. Specifically, by using the monohydric alcohol a3 having an oxyalkylene structure, the lubricant composition easily reduces friction even in rigorous conditions such as a high temperature and/or a high pressure. Furthermore, the lubricant composition easily exerts excellent abrasion resistance and seizure resistance even in rigorous conditions such as a high temperature and/or a high pressure.

As the monohydric alcohol a3, compounds which have an alkyl group having greater than or equal to 10 carbon atoms and/or have an alkyl group with a branched structure, and/or have an oxyalkylene structure are more preferable, and compounds which have an alkyl group with a branched structure having greater than or equal to 10 carbon atoms and in which one or more carbon atoms that are not adjacent to each other in carbon atoms are substituted with an oxygen atom (that is, which have an oxyalkylene structure) are particularly preferable.

Examples of the monohydric alcohol a3 suitable for the present invention include methanol, ethanol, butanol, isobutanol, pentanol, propanol, hexanol, 2-ethylhexanol, heptanol, octanol, decanol, dodecanol, hexadecanol, octadecanol, 2-heptyl undecanol, eicosadecanol, phytosterol, isostearyl alcohol, stearol, cetole, behenol, or alkylene oxide adducts of such monohydric alcohol.

The monohydric alcohol a3 used in the present invention preferably has an oxyalkylene structure, and is more preferably represented by General Formula (3).

$$R^a\text{-}(O(CX_{a1}X_{a2})_{na1})_{na2}OH \qquad \text{General Formula (3)}$$

Here, in General Formula (3), $R^a$ represents an alkyl group which may have a substituent, a cycloalkyl group which may have a substituent, an alkenyl group which may have a substituent, an aryl group which may have a substituent, or a heteroaryl group which may have a substituent, and $X^{a1}$ and $X^{a2}$ each independently represent a hydrogen atom, a halogen atom, or an alkyl group. In addition, na1 represents an integer of 2 to 4, and na2 represents an integer of 1 to 20. A plurality of $X^{a1}$'s may be the same or different from each other, and a plurality of $X^{a2}$'s may be the same or different from each other. In addition, in a case where na2 is greater than or equal to 2, a plurality of $—O(CX^{a1}X^{a2})_{na1}$'s may be the same or different from each other.

In a case where $R^a$ is an alkyl group which may have a substituent, the number of carbon atoms in the alkyl group moiety is preferably 2 to 25, is more preferably 4 to 22, is even more preferably 6 to 20, and is particularly preferably 8 to 18. The alkyl group represented by $R^a$ may be linear or branched. Being branched is not only preferable from the viewpoint of lubrication properties in rigorous conditions such as a high temperature and/or a high pressure, but also preferable from the viewpoint of solubility in a case of being used as an additive for base oil. In addition, $R^a$ may be a cycloalkyl group which may have a substituent.

In a case where $R^a$ is an alkenyl group which may have a substituent, the number of carbon atoms in the alkenyl group moiety is preferably 3 to 22, is more preferably 4 to 18, and is even more preferably 8 to 18. The alkenyl group represented by $R^a$ may be linear, branched, or cyclic.

In a case where $R^a$ is an aryl group or a heteroaryl group which may have a substituent, the number of carbon atoms in the aryl group moiety is preferably 6 to 17, and is more preferably 6 to 12. Examples of the aryl group represented by $R^a$ include a phenyl group and a naphthyl group. Among them, the phenyl group is particularly preferable. In addition, as the heteroaryl group represented by $R^a$, for example, an imidazolyl group, a pyridyl group, a quinolyl group, a furyl group, a thienyl group, a benzoxazolyl group, an indolyl group, a benzimidazolyl group, a benzthiazolyl group, a carbazolyl group, and an azepinyl group can be exemplified. The heteroatom contained in the heteroaryl group is preferably an oxygen atom, a sulfur atom, and a nitrogen atom. Among them, the oxygen atom is preferable.

Among them, in General Formula (3), $R^a$ is more preferably an alkyl group which may have a substituent.

Examples of the substituent that $R^a$ may have a substituted or unsubstituted alkyl group having 1 to 50 carbon atoms (for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl, each of which is linear or branched); an alkenyl group having 2 to 35 carbon atoms (for example, propenyl, butenyl, pentenyl, hexenyl, heptenyl, octenyl, nonenyl, decenyl, undecenyl, and dodecenyl); a cycloalkyl group having 3 to 10 carbon atoms (for example, cyclopropyl, cyclobutyl, cyclopentyl, cyclohexyl, and cycloheptyl); an aromatic cyclic group having 6 to 30 carbon atoms (for example, phenyl, naphthyl, biphenyl, phenanthryl, and anthracenyl); a heterocyclic group (which is preferably a residue of a heterocycle containing at least one hetero atom selected from a nitrogen atom, an oxygen atom, or a sulfur atom, and includes, for example, pyridyl, pyrimidyl, triazinyl, thienyl, furyl, pyrrolyl, pyrazolyl, imidazolyl, triazolyl, thiazolyl, imidazolyl, oxazolyl, thiadiazolyl, oxazolyl, quinolyl, and isoquinolyl); or a group composed of a combination thereof. These substituents may further have one or more substituents, if possible, and examples of the substituents include an alkoxy group, an alkoxycarbonyl group, a halogen atom, a silicon atom, an ether group, an alkylcarbonyl group, a cyano group, a thioether group, a sulfoxide group, a sulfonyl group, and an amide group.

In addition, in General Formula (3), $X^{a1}$ and $X^{a2}$ each independently represent a hydrogen atom, a halogen atom, or an alkyl group, with the hydrogen atom and the alkyl group being more preferable. A preferable range of the alkyl group represented by $X^{a1}$ and $X^{a2}$ is the same as the preferable range of the alkyl group moiety in the alkyl group represented by $R^a$ which may have a substituent.

In General Formula (3), na1 represents an integer of 2 to 4, more preferably an integer of 2 or 3, and even more preferably 2.

In addition, na2 represents an integer of 1 to 20, more preferably an integer of 1 to 15, even more preferably an integer of 1 to 10, and particularly preferably an integer of 1 to 7.

Specific examples of the monohydric alcohol a3 which can be used in the present invention are shown below. However, the present invention is not limited thereto.

MA-1

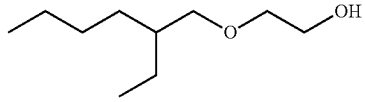

MA-2

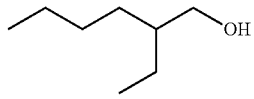

MA-3

$C_{18}H_{37}(OCH_2CH_2)_4OH$

MA-4

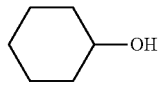

MA-5

$CH_3CH_2OH$

MA-6

$CH_3(CH_2)_2OH$

MA-7

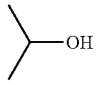

MA-8

$CH_3(CH_2)_3OH$

MA-9

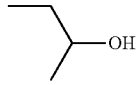

-continued

MA-10 $CH_3(CH_2)_9OH$

MA-11 $CH_3(CH_2)_{11}OH$

MA-12 $CH_3(CH_2)_{13}OH$

MA-13 $CH_3(CH_2)_{15}OH$

MA-14 $CH_3(CH_2)_{17}OH$

MA-15 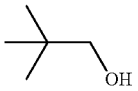

MA-16 $CH_3(OC_2H_4)_2OH$

MA-17 $C_2H_5(OC_2H_4)_3OH$

MA-18 $C_4H_9(OC_3H_6)_3OH$

MA-19 $CH_3(OC_2H_4)_8OH$

MA-20 $C_2H_5(OC_4H_6)_5OH$

MA-21 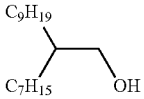

MA-22 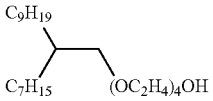

MA-23 $(CH_3)_3Si(OSi(CH_3)_2)_4(OC_2H_4)_4OH$

MA-24 $C_6F_{13}CH_2CH_2OH$

MA-25 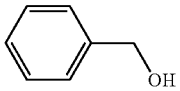

MA-26 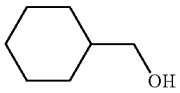

MA-27 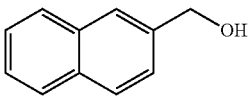

MA-28 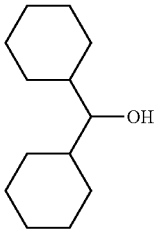

-continued

MA-29 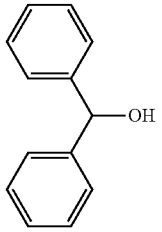

MA-30 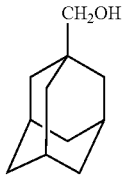

MA-31 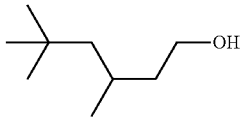

MA-32 $CH_3OH$

MA-33 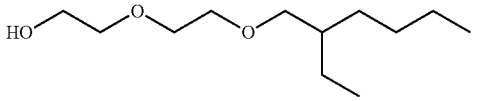

MA-34 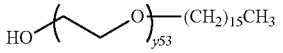

MA-35 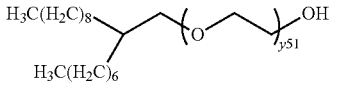

MA-36 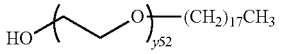

An average value of y53 in the compound MA-34 is 4, an average value of y51 in MA-35 is 10, and an average value of y52 in MA-36 is 20.

<Monovalent Carboxylic Acid a4>

Examples of the monovalent carboxylic acid a4 in the present invention include an aliphatic carboxylic acid, an aromatic carboxylic acid, and carboxylic acid precursors thereof. Among them, the monovalent carboxylic acid a4 is preferably an aliphatic carboxylic acid and a carboxylic acid precursor thereof. The number of carbon atoms of the monovalent carboxylic acid a4 is preferably greater than or equal to 5, is more preferably greater than or equal to 8, and is even more preferably greater than or equal to 9. By setting the number of carbon atoms of the monovalent carboxylic acid a4 to be in the range described above, it is possible to further increase lubrication properties of the lubricant composition even in rigorous conditions such as a high temperature and/or a high pressure. The number of carbon atoms of the monovalent carboxylic acid a4 represents the number of carbon atoms which also includes a carbon atom constituting the carboxyl group.

The monovalent carboxylic acid a4 preferably has a branched alkyl structure. By using the monovalent carboxylic acid a4 having a branched alkyl structure, it is possible to further increase lubrication properties of the lubricant composition even in rigorous conditions such as a high temperature and/or a high pressure.

A more preferable monovalent carboxylic acid a4 is an aliphatic monovalent carboxylic acid having greater than or equal to 9 carbon atoms and having a branched alkyl group, or an aliphatic monovalent carboxylic acid with a linear or branched alkyl group having greater than or equal to 13 carbon atoms.

Specific examples of the preferable monovalent carboxylic acid a4 include a monovalent carboxylic acid having a linear alkyl group such as a butanoic acid, a pentanoic acid, a hexanoic acid, a heptanoic acid, an octanoic acid, a decanoic acid, a stearic acid, a dodecanoic acid, a lauric acid, a tetradecanoic acid, and a behenic acid, a monovalent carboxylic acid having a branched alkyl group such as 2,3,4,8,10,10-hexamethylundecane-5-carboxylic acid, 2-ethylhexanoic acid, 2-heptylundecanoic acid (isostearic acid), and an unsaturated fatty acid such as an oleic acid, a linoleic acid, an erucic acid, and a monomer acid. Among them, the stearic acid, the 2-ethylhexanoic acid, the 2-heptylundecanoic acid (isostearic acid), and the oleic acid are preferable, with the 2-heptylundecanoic acid (isostearic acid) and the oleic acid being more preferable.

<Compound B Having Hydroxyl Number Greater than 50 mgKOH/g>

The compound B having a hydroxyl number greater than 50 mgKOH/g may be either a low molecular weight compound or a polymer, with the low molecular weight compound being preferable. A molecular weight of the compound B is preferably less than or equal to 1,000 and is more preferably less than or equal to 500.

The hydroxyl number is an amount (mg) of potassium hydroxide required to neutralize an acetic acid bound to a hydroxyl group in a case where 1 g of a sample is acetylated, and is expressed in mgKOH/g. The hydroxyl number is also referred to as a hydroxyl value.

The hydroxyl number can be measured by the method of JIS K 0070. In addition, in a case of a single compound of which a molecular weight and a hydroxyl number are known, the hydroxyl number can be calculated by the following expression.

(Molecular weight of potassium hydroxide)×(hydroxyl number)×1,000/molecular weight of compound It is sufficient that the hydroxyl number of the compound B is greater than 50 mgKOH/g. The hydroxyl number is preferably greater than 100 mgKOH/g, is more preferably greater than 150 mgKOH/g, and is even more preferably greater than 200 mgKOH/g. An upper limit of the hydroxyl number of the compound B is not particularly limited. The upper limit is preferably less than 500 mgKOH/g and is more preferably less than 450 mgKOH/g.

The compound B has, in a molecule thereof, preferably a hydrocarbon group having greater than or equal to 4 carbon atoms, more preferably a hydrocarbon group having greater than or equal to 8 carbon atoms, and even more preferably a hydrocarbon group having greater than or equal to 12 carbon atoms. The hydrocarbon group is preferably an alkyl group, an alkenyl group, an aryl group, and an aralkyl group, with the alkyl group and the alkenyl group being more preferable.

In addition, the number of hydroxyl groups possessed by the compound B is preferably 1 to 10 and is more preferably 2 to 4.

Specific examples of the compound B which can be used in the present invention are shown below. However, the present invention is not limited thereto.

B-1

Glycerin monooleic acid ester
Hydroxyl number = 315

B-2

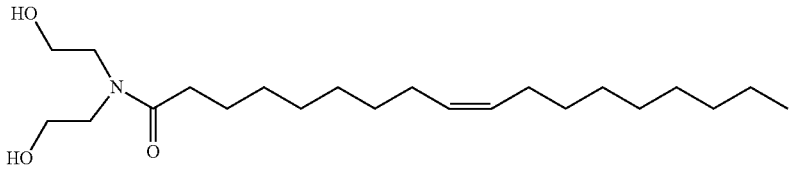

Hydroxyl number = 304

B-3

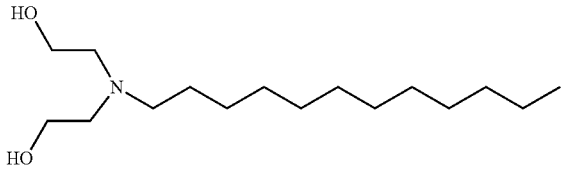

Hydroxyl number = 410

-continued

B-4

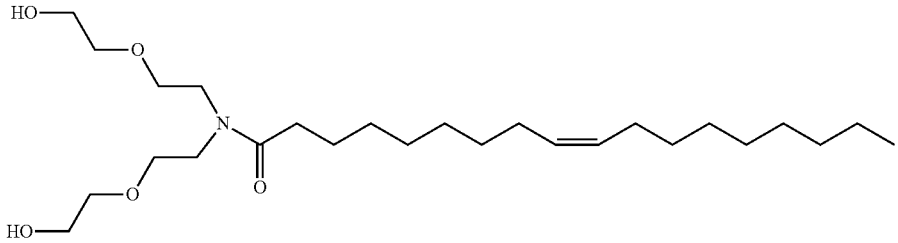

Hydroxyl number = 245

B-5

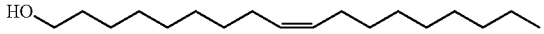

Hydroxyl number = 209

B-6

Pentaerythritol dioleic acid ester
Hydroxyl number = 169

B-7

Pentaerythritol trioleic acid ester
Hydroxyl number = 60

B-8

Glycerin dioleic acid ester
Hydroxyl number = 90

B-9

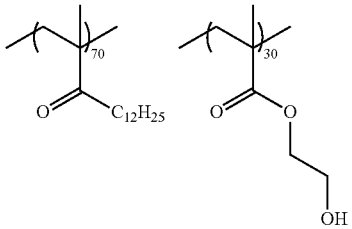

Mw = 20000
Hydroxyl number = 82

B-10

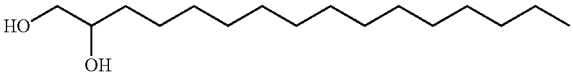

Hydroxyl number = 434

Among them, it is preferable that the compound B has at least one structure selected from an ester structure, an amine structure, or an amide structure. Even in this case, the compound B has, in a molecule thereof, preferably a hydrocarbon group having greater than or equal to 4 carbon atoms, more preferably a hydrocarbon group having greater than or equal to 8 carbon atoms, and most preferably a hydrocarbon group having greater than or equal to 12 carbon atoms. The hydrocarbon group is preferably an alkyl group, an alkenyl group, an aryl group, and an aralkyl group, with the alkyl group and the alkenyl group being more preferable.

Preferable examples of the compound B include polyol partial fatty acid ester, hydroxy group-containing amine, and fatty acid amide of hydroxy group-containing amine.

Specifically, it is preferable that the compound B is a compound represented by any one of General Formulae 1 to 3.

General Formula 1

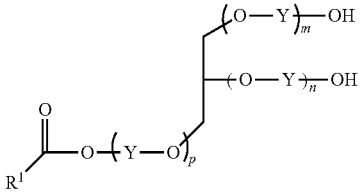

-continued

General Formula 2

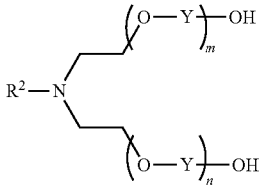

General Formula 3

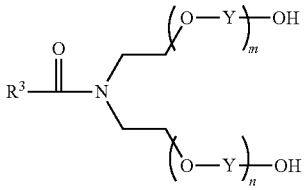

In General Formulae 1 to 3, $R^1$ to $R^3$ each independently represent a hydrocarbon group having 4 to 30 carbon atoms. Y represents an alkylene group having 2 to 4 carbon atoms, and, in a case where a plurality of Y's are present in one molecule, the plurality of Y's may be the same or different from each other. m, n, and p each independently represent an integer of 0 to 20.

In General Formulae 1 to 3, $R^1$ to $R^3$ each independently represent a hydrocarbon group having 4 to 30 carbon atoms, preferably a hydrocarbon group having 8 to 30 carbon atoms, and more preferably a hydrocarbon group having 12 to 24 carbon atoms. In addition, m and n each independently represent an integer of 0 to 20, preferably an integer of 0 to 10, and more preferably an integer of 0 to 5.

In a case where the compound B is a polymer, the compound B is preferably a copolymer containing a hydroxyl group-containing repeating unit and an alkyl group-containing repeating unit, and is more preferably a copolymer containing a hydroxyl group-containing (meth) acrylate and an alkyl group-containing (meth)acrylate as constitutional units. In this case, a weight-average molecular weight of the compound B is preferably 5,000 to 500,000, is more preferably 7,000 to 300,000, and is even more preferably 10,000 to 200,000.

In a case where the compound B is a polymer or a mixture and is not composed of a single compound, it is sufficient that an average hydroxyl number of the polymer or the mixture is larger than 50. In the polymer or the mixture, a proportion of the compound having a hydroxyl number of less than or equal to 50 mgKOH/g is preferably less than or equal to 50% in a mass proportion.

<Manufacturing Step>

The manufacturing method of a lubricant composition includes a step of mixing the composite ester A that contains polyester obtained by condensing the trihydric or more polyhydric alcohol a1, the divalent or more polyvalent carboxylic acid a2, and at least one selected from the monohydric alcohol a3 or the monovalent carboxylic acid a4, with the compound B having a hydroxyl number of greater than 50 mgKOH/g. The manufacturing method of a lubricant composition of the embodiment of the present invention includes a step (step A) of condensing the trihydric or more polyhydric alcohol a1, the divalent or more polyvalent carboxylic acid a2, and at least one selected from the monohydric alcohol a3 or the monovalent carboxylic acid a4, to obtain the composite ester A, and a step (step B) of mixing the composite ester A with the compound B having a hydroxyl number of greater than 50 mgKOH/g.

<Step A>

The step (step A) of obtaining the composite ester A is a step of carrying out a condensation reaction of the trihydric or more polyhydric alcohol a1, the divalent or more polyvalent carboxylic acid a2, and at least one selected from the monohydric alcohol a3 or the monovalent carboxylic acid a4. In the present invention, the step (step A) of obtaining the composite ester A is preferably a step of carrying out a condensation reaction of the trihydric or more polyhydric alcohol a1, the divalent or more polyvalent carboxylic acid a2, and the monohydric alcohol a3.

The condensation reaction is carried out in such a manner that in the above components (raw materials), a molar ratio of carboxyl groups/hydroxyl groups in total carboxylic acids and total alcohol is preferably 2/1 to 1/2, is more preferably 1.5/1 to 1/1.5, is even more preferably from 1/1 to 1/1.3, and is particularly preferably 1/1 to 1/1.2. By using alcohol in excess, an acid value of a condensate can be decreased, so that damage to a member which is imparted by the resulting lubricant can be suppressed.

A molar ratio of carboxyl groups (component (a2)/component (a4)) of the component (a2) and the component (a4) in total carboxylic acids is preferably 1/0 to 1/20. In a case where the component (a3) is not used in the condensation reaction, a ratio of the component (a2)/the component (a4) is preferably 1.5/1 to 1/10 and is more preferably 1/1 to 1/5.

A molar ratio of hydroxyl groups (component (a1)/component (a3)) in total alcohol is preferably 1/0 to 1/20. In a case where the component (a4) is not used for the condensation reaction, a ratio of the component (a1)/the component (a3) is preferably 1.5/1 to 1/10 and is more preferably 1.5/1 to 1/2.

However, in the ratio of the component (a2)/the component (a4) and the ratio of the component (a1)/the component (a3), the component (a3) and the component (a4) do not become 0 at the same time. In other words, molar masses of the components (a3) and (a4) used in the condensation reaction of the composite ester A are not 0 at the same time, and at least one of the components is used in the condensation reaction.

A mixture (raw material mixture) of the trihydric or more polyhydric alcohol a1, the divalent or more polyvalent carboxylic acid a2, and at least one selected from the monohydric alcohol a3 or the monovalent carboxylic acid a4 is condensed in the presence of a catalyst or a condensing agent, or in the absence of a catalyst, to obtain the composite ester A. At the time of the condensation, it is preferable to perform heating in the absence of a solvent or in the presence of a solvent. In a case where a solvent is used, it is preferable to cause a solvent, which is azeotropic with water or low molecular alcohol, to be present in an appropriate amount. Accordingly, the reaction also proceeds smoothly without coloring the product. In a case where a solvent is used, the solvent is preferably a hydrocarbon-based solvent having a boiling point of 100° C. to 200° C., is more preferably a hydrocarbon-based solvent having a boiling point of 100° C. to 170° C., and is most preferably a hydrocarbon-based solvent having a boiling point of 110° C. to 160° C. Examples of the solvent include toluene, xylene, mesitylene, and the like. A content of the solvent in the mixture is preferably 1% to 25% by mass, is more preferably 2% to 20% by mass, is even more preferably from 3% to 15% by mass, and is particularly preferably 5% to 12% by mass, with respect to the total mass. By setting an amount added of the solvent to be in the range described above, azeotropic and condensation reactions can proceed smoothly.

The condensation reaction is accelerated by using a catalyst. However, since a treatment for removing the catalyst after the reaction is complicated and the product is colored, it is preferable not to use a catalyst in the condensation reaction. In a case where the catalyst is used, a general catalyst is used, and a general condition and a general operation are applied. This can be referred to references such as JP2001-501989A, JP2001-500549A, JP2001-507334A, and JP2002-509563A.

The condensation reaction is carried out at a liquid temperature of 120° C. to 250° C., preferably at a liquid temperature of 130° C. to 230° C., more preferably at a liquid temperature of 150° C. to 230° C., and particularly preferably at a liquid temperature of 170° C. to 230° C. As a result, the solvent containing water produced by the condensation reaction is azeotropic. By cooling gas generated by azeotropy at a cooling position, the solvent containing water can be separated. The water may be removed. After the reaction is performed at a low temperature, the reaction may be further performed at a high temperature.

In a case where an amount of theoretically generated water is calculated from a molar number of the raw material mixture, a reaction time is preferably a time required to obtain such an amount of water. Even in a case where the reaction ends at a time point at which the amount of the theoretically generated water is 60 to 90%, the lubrication properties of the lubricant composition containing the obtained composite ester A are excellent. The reaction time is 1 to 24 hours, is preferably 3 to 18 hours, is more preferably 5 to 18 hours, and is most preferably 6 to 15 hours.

A kinematic viscosity of the composite ester A at 40° C. is preferably 50 to 2,000 $mm^2/s$. The kinematic viscosity of the composite ester A at 40° C. is preferably 50 $mm_2/s$, is more preferably 70 $mm_2/s$, and is even more preferably 100

$mm_2/s$. The kinematic viscosity at 40° C. of the composite ester A is preferably less than or equal to 2,000 $mm_2/s$, is more preferably less than or equal to 1,500 $mm_2/s$, and is even more preferably less than or equal to 1,000 $mm_2/s$. By setting the kinematic viscosity of the composite ester A to be in the range described above, it is possible to suppress a friction coefficient of the lubricant composition to a low level. Herein, specifically, a value measured in a thermostatic water tank at 40.0° C. by using an UBBELOHDE viscosimeter is adopted as the kinematic viscosity of the composite ester A at 40° C.

A molecular weight of the composite ester A is preferably 1,000 to 100,000, is more preferably 2,000 to 20,000, and is even more preferably 3,000 to 10,000, in a weight-average molecular weight in terms of standard polystyrene using a gel permeation chromatography (GPC). By setting the molecular weight to be in a suitable range, it is possible to suppress an increase in viscosity of the lubricant composition and to increase abrasion resistance. In addition, by setting the molecular weight of the composite ester A to be in a suitable range, it is possible to suppress a friction coefficient of the lubricant composition to a low level. Herein, specifically, a value measured in the following conditions is adopted as the weight-average molecular weight of the composite ester A in terms of polystyrene.

"HLC-8220GPC (manufactured by TOSOH CORPORATION) device". As columns, three columns of "TSKgel, SuperHZM-H (manufactured by TOSOH CORPORATION, 4.6 mmID×15 cm)", "TSKgel, SuperHZ4000 (manufactured by TOSOH CORPORATION, 4.6 mmID×15 cm)", and TSKgel, SuperHZ2000 (manufactured by TOSOH CORPORATION, 4.6 mmID×15 cm)" were used.

For example, the following conditions can be adopted as the conditions of GPC.

Eluant Tetrahydrofuran (THF)
Flow Rate 0.35 m1/min
Measurement Temperature 40° C. (Column, Inlet, RI)
Detector Refractive Index Detector
Analysis Time 20 minutes
Sample Concentration 0.1%
Sample Injection Amount 10 μl In the composite ester A, unreacted COOH may remain or OH may remain. However, in a case where OH and COOH remain, a hydroxyl number and an acid value are increased, which may not be preferable depending on an application. In such a case, acylation and/or esterification treatment is separately performed to eliminate OH and COOH, so that the hydroxyl number and the acid value can be decreased. The hydroxyl number of the unreacted compound contained in the composite ester A is preferably less than or equal to 50 mgKOH/g, is more preferably less than or equal to 40 mgKOH/g, and is even more preferably less than or equal to 30 mgKOH/g.

In addition, an acid value of the composite ester A (the number of mg of KOH required for neutralizing 1 g of a sample) is not particularly limited. The acid value is preferably 0 to 50 mgKOH/g, is more preferably 0 to 30 mgKOH/g, and is even more preferably 0 to 20 mgKOH/g. Specifically, for the acid value of the composite ester A, a value measured according to a JISK2501 method is used.

After a reaction ends and after a post-reaction treatment ends, it is preferable to carry out filtration so that impurities and the like are removed. In a case where a product becomes a solid, the product can be taken out by melting or taken out as powders by reprecipitation.

Preferable specific examples of the composite ester A can include the composite ester A's obtained by condensing the components shown in Table 1. In Table 1, the functional group equivalent ratio is an equivalent ratio of carboxyl groups to hydroxyl groups.

TABLE 1

| | Polyhydric alcohol a1 | | Polyvalent carboxylic acid a2 | | Monohydric alcohol a3 | | Monovalent carboxylic acid a4 | |
|---|---|---|---|---|---|---|---|---|
| Composite ester A | Type | Functional group equivalent ratio | Type | Functional group equivalent ratio | Type | Functional group equivalent ratio | Type | Functional group equivalent ratio |
| A-1 | a1-a | 3.5 | CA-26 | 6 | MA-1 | 3.5 | — | — |
| A-2 | a1-a | 3 | CA-26 | 6 | MA-1 | 4 | — | — |
| A-3 | a1-a | 3 | CA-26 | 6 | MA-1 | 3 | — | — |
| A-4 | a1-e | 3.5 | CA-28 | 6 | MA-33 | 3.5 | — | — |
| A-5 | a1-a | 3 | CA-26 | 6 | MA-36 | 3 | — | — |
| A-6 | a1-d | 1 | CA-27 | 3 | MA-1 | 3 | — | — |
| A-7 | a1-a | 3.5 | CA-26 | 6 | MA-2 | 3.5 | — | — |
| A-8 | a1-b | 4 | CA-1 | 8 | MA-17 | 5 | — | — |
| A-9 | a1-b | 4 | CA-5 | 8 | MA-3 | 5 | — | — |
| A-10 | a1-a | 3.5 | CA-1 | 6 | MA-2 | 3.5 | — | — |
| A-11 | a1-b | 4.5 | CA-26 | 1 | — | | OLA | 3 |
| A-12 | a1-d | 3.5 | CA-27 | 0.5 | — | | ST | 3 |

OLA: Oleic acid
ST: Stearic acid

<Step B>

The step B is a step of mixing the composite ester A with the compound B having a hydroxyl number greater than 50 mgKOH/g. In the step B, the composite ester A obtained in the above-mentioned step A and compound B are mixed. In this case, only the composite ester A and the compound B may be mixed, or the composite ester A and the compound B may be added to a medium such as base oil and mixed. In addition, in the step B, other additives may be mixed. In the step B, the composite ester A and the compound B may first be mixed and then mixed with the medium or the other additives, or all the components may be mixed at once.

In the mixing step, it is preferable to carry out heating and stirring. A heating temperature is preferably 30° C. to 200° C., more preferably 40° C. to 150° C., and even more preferably 50° C. to 100° C. After mixing, it is preferable to carry out filtration using a filter or the like so that particles and solids are removed.

A mixing ratio of the composite ester A to the compound B is, as a mass ratio (composite ester A:compound B), preferably 100:1 to 1:50, more preferably 50:1 to 1:20, more preferably 30:1 to 1:10, and particularly preferably 20:1 to 1:1. By setting the mixing ratio of the composite ester A to the compound B to be in the range described above, it is possible to increase lubrication properties of the lubricant composition. In particular, a friction coefficient of the lubricant composition can be suppressed to a low level in rigorous conditions such as a high temperature and/or a high pressure, and abrasion resistance and seizure resistance are easily exerted.

In the step B, in a case of being mixed with the medium, examples of the medium include base oil of Groups I to V. Specific examples thereof can include one type or two or more types selected from mineral oil, a fatty oil compound, polyolefin oil (for example, poly alpha olefin), silicone oil, perfluoropolyether oil, ester oil (for example, aromatic ester oil, monovalent fatty acid ester, divalent fatty acid diester, and polyol ester lubricating oil), and a diphenyl ether derivative.

In the present invention, the "medium" indicates all mediums which are generally referred to as a "fluidic liquid". Here, it is not necessary that the medium is in a liquid state at room temperature or at a temperature to be used, but a material in any state such as a solid and a gel other than the liquid can be used. The medium which is used in the present invention is not particularly limited, and can be selected from various liquids according to the application. The medium which can be used in the present invention can be referred to the description in paragraphs 0067 to 0096 of JP2011-089106A. The kinematic viscosity of the medium at 40° C. is preferably 1 to 500 $mm^2/s$, is more preferably 1.5 to 200 $mm^2/s$, and is even more preferably 2 to 50 $mm^2/s$.

The viscosity index of the medium is preferably greater than or equal to 90, is more preferably greater than or equal to 105, and is even more preferably greater than or equal to 110. In addition, it is preferable that the viscosity index of the medium is less than or equal to 160. By setting the viscosity index to be in the range described above, viscosity-temperature properties, heat and oxidation stability, and volatilization inhibiting properties are improved, and abrasion inhibiting properties are improved. Furthermore, the viscosity index in the present invention indicates a viscosity index measured on the basis of JIS K 2283-1993.

In a case where the other additives are added in the step B, examples of the additives can include one type or two or more types selected from an abrasion inhibiting agent, a viscosity index improving agent (preferably, polyalkyl (meth)acrylate, alkyl (meth)acrylate, a (meth)acrylate copolymer having a polar group), an antioxidant (preferably, a phenol compound, an amine compound), a detergent (preferably, Ca sulfonate, Ca phenate, Mg sulfonate, Ca salicylate, (boric acid-modified) succinimide, succinic acid ester), a dispersant, a flow agent, a curing agent, a corrosion inhibiting agent, a sealing compliance agent, an anti-foaming agent (preferably, polydimethyl silicone), a rust inhibiting agent, a friction adjusting agent, and a thickener.

By adding such an additive, it is possible to provide a function such as abrasion suppression, which is preferable as a lubricant. The additive which can be used in the present invention can be referred to the description in paragraphs 0098 to 0165 of JP2011-089106A.

In the present invention, it is preferable that the step B further includes a step of adding a compound containing at least one atom selected from molybdenum, zinc, phosphorus, or sulfur. Such a compound has a function of a friction adjusting agent, an abrasion inhibiting agent, an antioxidant, and the like. The compound containing at least one atom selected from molybdenum, zinc, phosphorus, or sulfur indicates a compound which may contain molybdenum, zinc, phosphorus, and sulfur in the compound in any state. Specifically, examples of the compound can include a compound containing molybdenum, zinc, phosphorus, and sulfur as a single body (the oxidation number of 0), an ion, a complex, and the like.

Examples of such a compound include an organic molybdenum compound, an inorganic molybdenum compound, an organic zinc compound, a phosphoric acid derivative, an organic sulfur compound, and the like. Among them, the organic molybdenum compound and the organic zinc compound are preferable.

In addition, in the step B, only one type of the compound containing at least one atom selected from molybdenum, zinc, phosphorus, or sulfur may be added, or a combination of two or more types of the compounds may be added. In a case where the combination of two or more types of the compounds containing at least one atom selected from molybdenum, zinc, phosphorus, or sulfur is added, it is preferable that two or more types of the organic molybdenum compound, the inorganic molybdenum compound, the organic zinc compound, the phosphoric acid derivative, and the organic sulfur compound are combined, and it is more preferable that the organic molybdenum compound and the organic zinc compound are combined.

In the step B, the composite ester A and the compound B may be mixed after adding the compound containing at least one atom selected from molybdenum, zinc, phosphorus, or sulfur to the composite ester A, or the composite ester A and the compound B may be mixed after adding the compound containing at least one atom selected from molybdenum, zinc, phosphorus, or sulfur to the compound B. In addition, the compound containing at least one atom selected from molybdenum, zinc, phosphorus, or sulfur, the composite ester A, and the compound B may be simultaneously mixed.

Hereinafter, a preferred aspect of each of the organic molybdenum compound, the inorganic molybdenum compound, and the organic zinc compound will be described.

Examples of the organic molybdenum compound which is used in the lubricant composition as an additive can include an organic molybdenum compound containing phosphorus, such as molybdenum dithiophosphate (also referred to as MoDTP). Examples of another organic molybdenum compound can include an organic molybdenum compound containing sulfur, such as molybdenum dithiocarbamate (also referred to as MoDTC). For example, oxy molybdenum-N, N-di-octyl dithiocarbamate sulfide ($C_8$—Mo(DTC)), oxy molybdenum-N,N-di-tridecyl dithiocarbamate sulfide ($C_{13}$—Mo(DTC)), and the like are preferable as the organic molybdenum compound containing sulfur.

Examples of another organic molybdenum compound containing sulfur can include a complex with the inorganic molybdenum compound. Examples of the inorganic molybdenum compound to be used in the organic molybdenum compound which is the complex between the inorganic molybdenum compound and the sulfur-containing organic compound can include molybdenum oxide such as molybdenum dioxide and molybdenum trioxide, a molybdic acid such as an orthomolybdic acid, a paramolybdic acid, and (poly)molybdic sulfide, a molybdate such as a metal salt and an ammonium salt of the molybdic acids, molybdenum sulfide such as molybdenum disulfide, molybdenum trisulfide, molybdenum pentasulfide, and polymolybdenum sulfide, molybdic sulfide, a metal salt or an amine salt of the molybdic sulfide, molybdenum halide such as molybdenum chloride, and the like. In addition, examples of the sulfur-containing organic compound to be used in the organic molybdenum compound which is the complex between the inorganic molybdenum compound and the sulfur-containing organic compound can include alkyl (thio)xanthate, thiadiazole, mercaptothiadiazole, thiocarbonate, tetrahydrocarbyl thiuram disulfide, bis(di(thio)hydrocarbyl dithiophosphonate)disulfide, organic (poly)sulfide, ester sulfide, and the like.

Examples of another organic molybdenum compound containing sulfur can include a complex between a sulfur-containing molybdenum compound such as molybdenum sulfide and molybdic sulfide, and alkenyl succinic acid imide.

An organic molybdenum compound which does not contain phosphorus or sulfur as a constituent element can be used as the organic molybdenum compound. Specifically, examples of the organic molybdenum compound which does not contain phosphorus or sulfur as a constituent element include a molybdenum-amine complex, a molybdenum-succinic acid imide complex, a molybdenum salt of an organic acid, a molybdenum salt of alcohol, and the like, and among them, the molybdenum-amine complex, the molybdenum salt of the organic acid, and the molybdenum salt of the alcohol are preferable.

As the inorganic molybdenum compound, it is possible to use the inorganic molybdenum compound to be used in the organic molybdenum compound which is the complex between the inorganic molybdenum compound and the sulfur-containing organic compound, and it is possible to use the inorganic molybdenum compounds as listed above.

Zinc dithiophosphate (ZDTP) represented by General Formula (4) is preferable as the organic zinc compound which is used in the lubricant composition as the additive.

General Formula (4)

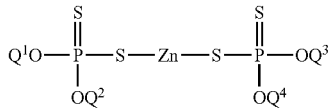

In General Formula (4), $Q^1$, $Q^2$, $Q^3$, and $Q^4$ may be identical to each other or different from each other, and each independently represent an alkyl group having 3 to 20 carbon atoms such as an isopropyl group, a butyl group, an isobutyl group, a pentyl group, an isopentyl group, a neopentyl group, a hexyl group, a heptyl group, an octyl group, a2-ethyl hexyl group, a nonyl group, a decyl group, an undecyl group, a dodecyl group, a tridecyl group, an isotridecyl group, a myristyl group, a palmityl group, and a stearyl group.

Specifically, a zinc n-butyl-n-pentyl dithiophosphoric acid ($C_4/C_5$ ZnDTP), a zinc di-2-ethyl hexyl dithiophosphoric acid ($C_8$ ZnDTP), or a zinc isopropyl-1-ethyl butyl dithiophosphoric acid ($C_3/C_6$ ZnDTP) are preferable as the zinc dithiophosphate represented by General Formula (4).

In the step B, in a case where the organic molybdenum compound is added, for an addition amount thereof, the organic molybdenum compound is added so that a Mo content is preferably 10 to 5,000 mg/kg (10 to 5,000 ppm), is more preferably 50 to 2,000 mg/kg, and is still more preferably 100 to 1,000 mg/kg, with respect to the total mass of the lubricant composition.

In addition, in a case where the organozinc compound is added, for an addition amount thereof, the organozinc compound is preferably added in an amount of 0.01% to 5% by mass, is more preferably added in an amount of 0.01% to 3% by mass, and is even more preferably added in an amount of 0.01% to 1% by mass, with respect to the total mass of the lubricant composition. By setting the content of the organic metal compound to be in the range described above, it is possible to increase stability of the lubricant composition, and it is possible to improve lubrication properties in rigorous conditions such as a high temperature and/or a high pressure. Specifically, a friction coefficient of the lubricant composition can be suppressed to a low level, and abrasion resistance and seizure resistance can be increased.

(Lubricant Composition)

The present invention also relates to a lubricant composition which contains the composite ester A that contains polyester obtained by condensing the trihydric or more polyhydric alcohol a1, the divalent or more polyvalent carboxylic acid a2, and at least one selected from the monohydric alcohol a3 or the monovalent carboxylic acid a4, and the compound B having a hydroxyl number of greater than 50 mgKOH/g. The lubricant composition of the embodiment of the present invention is preferably a lubricant composition manufactured by the manufacturing method of a lubricant composition described above.

In the composite ester A, in addition to the polyester obtained by condensing the trihydric or more polyhydric alcohol a1, the divalent or more polyvalent carboxylic acid a2, and at least one selected from the monohydric alcohol a3 or the monovalent carboxylic acid a4, a light component is contained. However, the light component is different from the compound B. That is, the compound B is different from the raw materials a1 to a3 which are used in the manufacture of the composite ester A, or from the compound obtained by reacting at least two of the raw materials a1 to a3. Whether the light component contained in the composite ester A is different from the compound B can be discriminated by making an observation as to whether or not the same compound is contained by the HPLC method (high performance liquid chromatography method) or the LC-MS method (liquid chromatography mass spectrometry method).

As the trihydric or more polyhydric alcohol a1, the divalent or more polyvalent carboxylic acid a2, and the monohydric alcohol a3 contained in the lubricant composition of the embodiment of the present invention, the compounds described in items of <Trihydric or more Polyhydric Alcohol a1>, <Divalent or more Polyvalent Carboxylic Acid a2>, and <Monohydric Alcohol a3> can be similarly enumerated, and preferable ranges thereof are also the same. In addition, for the compound B having a hydroxyl number of greater than 50 mgKOH/g to be contained in the lubricant composition of the embodiment of the present invention, the compounds described in an item of <Compound B having Hydroxyl number greater than 50 mgKOH/g> can be similarly enumerated, and a preferable range thereof is also the same.

A mass ratio (composite ester A:compound B) of the composite ester A to the compound B having a hydroxyl number greater than 50 mgKOH/g to be contained in the lubricant composition is preferably 100:1 to 1:50, is more preferably 50:1 to 1:20, is even more preferably 30:1 to 1:10, and is particularly preferably 20:1 to 1:1. By setting the mass ratio of the composite ester A to the compound B to be in the range described above, lubrication properties of the lubricant composition can be increased. In particular, a friction coefficient of the lubricant composition can be suppressed to a low level in rigorous conditions such as a high temperature and/or a high pressure, and abrasion resistance and seizure resistance are easily exerted.

A content of the composite ester A is preferably 0.1% to 10% by mass, is more preferably 0.2% to 5% by mass, and is even more preferably 0.5% to 3% by mass, with respect to the total mass of the lubricant composition. In addition, a content of the compound B is preferably 0.01% to 5% by mass, is more preferably 0.05% to 2% by mass, is even more preferably 0.1% to 1% by mass, with respect to the total mass of the lubricant composition.

The lubricant composition of the embodiment of the present invention may further contain a medium. Examples of the medium can include the base oil described in an item of <Step B>. A content of the medium is preferably 70% to 99.89% by mass with respect to the total mass of the lubricant composition.

The lubricant composition of the embodiment of the present invention may further contain other additives. Examples of the other additives can include the additives described in the item of <Step B>. Among them, it is preferable to further contain the compound containing at least one atom selected from molybdenum, zinc, phosphorus, or sulfur. In a case where the lubricant composition further contains the other additives, a content of the other additives is preferably less than or equal to 29.89% by mass with respect to the total mass of the lubricant composition.

<Grease Composition>

The lubricant composition of the embodiment of the present invention may be a grease composition. In a case where the lubricant composition of the embodiment of the present invention is a grease composition, the composite ester A and the compound B are mixed with grease and prepared. In such an aspect, in order to ensure practical performance in a case of being adapted for application of grease, and as necessary, a thickener or the like can be suitably added in a range not impairing the object of the present invention. In a case where the thickener is added, it is preferable to contain the thickener in an amount of 10% to 50% by mass with respect to the total mass of the grease composition. Hereinafter, an additive which can be added at the time of preparing the grease composition will be described.

Any thickener, for example, a soap-based thickener such as metal soap and composite metal soap, a non-soap-based thickener such as BENTON, silica gel, and a urea-based thickener (a urea compound, a urea and urethane compound, a urethane compound, and the like), and the like can be used as the thickener which can be added. Among them, the soap-based thickener and the urea-based thickener are preferably used since such thickeners rarely impair a resin member.

Examples of the soap-based thickener include sodium soap, calcium soap, aluminum soap, lithium soap, and the like, and among them, the lithium soap is preferable from the viewpoint of water resistance or heat stability. Examples of the lithium soap include lithium stearate, lithium-12-hydroxy stearate, or the like.

In addition, examples of the urea-based thickener include a urea compound, a urea and urethane compound, a urethane compound, or a mixture thereof, and the like.

Examples of the urea compound, the urea and urethane compound, and the urethane compound include a diurea compound, a triurea compound, a tetraurea compound, a polyurea compound (excluding a diurea compound, a triurea compound, and a tetraurea compound), a urea and urethane compound, a diurethane compound, or a mixture thereof, and the like. The diurea compound, the urea and urethane compound, the diurethane compound, or the mixture thereof is preferable.

The grease composition may also contain a solid lubricant as an additive. Examples of the solid lubricant include polytetrafluoroethylene, boron nitride, fullerene, black lead, graphite fluoride, melamine cyanurate, molybdenum disulfide, molybdenum (Mo)-dithiocarbamate, antimony sulfide, an alkali (earth) metal borate, and the like.

The grease composition may also contain wax as an additive. Various waxes such as natural wax, mineral oil-based wax, or synthesis-based wax can be exemplified as an example of wax, and specifically, examples of the wax include montan wax, carnauba wax, an amide compound of a higher fatty acid, paraffin wax, microcrystalline wax, polyethylene wax, polyolefin wax, ester wax, and the like.

In addition, benzotriazole, benzimidazole, thiadiazole, and the like are known as a metal deactivator, and can be added.

The thickener can be added to the grease composition. Examples of the thickener include polymethacrylate, polyisobutylene, polystyrene, and the like. It is known that the poly(meth)acrylate also has an effect of preventing abnormal noise at a low temperature in a cold region.

(Application of Lubricant Composition)

The lubricant composition of the embodiment of the present invention, for example, can be used for reducing friction by being supplied to a space between two sliding surfaces. The lubricant composition of the embodiment of the present invention can form a film on the sliding surface. Specifically, examples of the material of the sliding surface include carbon steel for a mechanical structure, alloy steel for a mechanical structure such as a nickel chromium steel material, a nickel chromium molybdenum steel material, a chromium steel material, a chromium molybdenum steel material, and an aluminum chromium molybdenum steel material, stainless steel, maraging steel, and the like.

Various metals other than steel, or inorganic materials or organic materials other than metal are also widely used as the material of the sliding surface. Examples of the inorganic material or the organic material other than metal include various plastics, ceramics, carbons, a mixed body thereof, and the like. More specifically, examples of the metal material other than steel include cast iron, a copper.copper-lead.aluminum alloy, casting thereof, and white metal.

Furthermore, the material of the sliding surface can be referred to the description in paragraphs 0168 to 0175 of JP2011-089106A.

The lubricant composition of the embodiment of the present invention can be used in various applications. For example, the lubricant composition of the embodiment of the present invention can be used as lubricating oil for grease, a releasing agent, oil for an internal combustion engine, engine oil for an internal combustion engine, oil for metal working (cutting), bearing oil, fuel for a combustion engine, vehicle engine oil, gear oil, operating oil for an automobile, lubricating oil for a vessel and an aircraft, machine oil, turbine oil, hydraulic operating oil, compressor and vacuum pump oil, freezer oil, a lubricating oil agent for metal working, a lubricant for a magnetic recording medium, a lubricant for a micro machine, a lubricant for an artificial bone, shock absorber oil, or rolling oil. Further, the lubricant composition of the embodiment of the present invention is also used in an air conditioner or a refrigerator including a reciprocating type airtight compressor or a rotating type airtight compressor, an air conditioner or a dehumidifier for an automobile, a cooling device of a freezer, a freezing refrigerating warehouse, a vending machine, a showcase, and a chemical plant, and the like.

The lubricant composition of the embodiment of the present invention can also be used as a lubricating oil agent for metal working which does not contain a chlorine-based compound. For example, in a case where a metal material such as an iron and steel material or an aluminum (Al) alloy is subjected to hot rolling, or is subjected to working such as cutting, the lubricant composition of the embodiment of the present invention can be used as metal working oil or metal plastic working oil such as cold rolling oil, cutting oil, grinding oil, drawing oil, and press working oil of aluminum. The lubricant composition of the embodiment of the present invention is, in particular, useful as an inhibitor against abrasion, damage, and surface roughness at the time of performing high-speed and high-load working, and is also useful as a metal working oil composition which can be applied to low-speed heavy cutting such as broach working and gun drill working.

In addition, the lubricant composition of the embodiment of the present invention can be used in various lubricating oils for grease, a lubricant for a magnetic recording medium, a lubricant for a micro machine, a lubricant for an artificial bone, and the like. Further, since the composition of the lubricant composition can be a carbohydrate, it can be used, for example, as an emulsifying, dispersing or solubilizing agent. By using an edible oil such as sorbitan fatty acid ester containing polyoxyethylene ether, which is widely used in cake mix, salad dressing, shortening oil, chocolate, and the like as base oil, it is possible to obtain high-performance lubricating oil which is entirely harmless to a human body. Such a lubricating oil can be used in a manufacturing device in a food manufacturing line or a medical instrument member.

Further, the lubricant composition of the embodiment of the present invention is dispersed by being emulsified in water system or is dispersed in a polar solvent or a resin medium, and thus, can be used as cutting oil or rolling oil.

In addition, the lubricant composition of the embodiment of the present invention can also be used as a releasing agent in various applications. For example, the lubricant composition of the embodiment of the present invention is used as a releasing agent of a polycarbonate resin, a flame retardant polycarbonate resin, a crystalline polyester resin which is a main component of a toner for forming an image used in an electrophotographic device, an electrostatic recording device, or the like, a thermoplastic resin composition for various moldings, an epoxy resin composition for sealing a semiconductor, and the like.

In addition, the lubricant composition of the embodiment of the present invention is kneaded into or is applied onto a fiber product of a clothing material or the like in advance, and thus, can be used as a stain-proofing agent which accelerates removal of stain attached onto the fiber product and prevents the fiber product from being stained.

EXAMPLES

Hereinafter, the characteristics of the present invention will be more specifically described with reference to examples and comparative examples. Materials, used amounts, ratios, treatment contents, treatment sequences, and the like of the following examples can be suitably changed unless the changes cause deviance from the gist of the present invention.

Accordingly, the range of the present invention will not be restrictively interpreted by the following specific examples.

<Synthesis of Composite Ester A>

The respective components (a1) to (a4) shown in Table 1 was added to a reaction vessel provided with a DEAN-STARK DEHYDRATION DEVICE so that the functional group equivalent ratio in Table 1 was obtained. This mixture was subjected to a reaction at 190° C. for 5 hours, and at 220° C. for 4 hours under nitrogen stream of 0.3 L/min. Water generated during the reaction was removed. A reactant was left to cool to room temperature, and thus, composite ester A was obtained as a yellow transparent liquid substance. The functional group equivalent ratio in Table 1 is an equivalent ratio of carboxyl groups to hydroxyl groups.

Examples 1-1 to 1-20 and Comparative Examples 1-1 to 1-5

The composite ester A and the compound B shown in Table 2 were mixed with base oil to prepare each of the lubricant compositions of Examples 1-1 to 1-20 and Comparative Examples 1-1 to 1-5. A friction coefficient, seizure resistance, and abrasion resistance of such a lubricant composition were evaluated by the following methods.

<Friction Coefficient>

The friction coefficient was measured using a vibration type friction abrasion tester (SRV 4, manufactured by Optimol Instruments Prueftechnik GmbH). In the measurement of the friction coefficient, a friction abrasion test was carried out for 1 hour under conditions of a frequency of 50 Hz, a load of 400 N, and an amplitude of 1 mm at a test temperature of 80° C., and a friction coefficient at the lapse of 30 minutes was measured. An SUJ-2 ball of 10 mm was used as an upper test piece of the friction abrasion test, and an SUJ-2 disk of 24 mm was used as a lower test piece. The observed friction coefficient was evaluated on the basis of the following standards. The results are shown in Table 2.

The friction coefficient of Comparative Example 1-1 was set to 100%. Based on this, other evaluation results were standardized, and evaluation was performed as described below. A smaller value indicates a smaller friction coefficient and excellent lubrication properties. An acceptance standard was a case of being evaluated as C or higher.

A: Less than 30%

B: Greater than or equal to 30% and less than 50%

C: Greater than or equal to 50% and less than 70%

D: Greater than or equal to 70% and less than 100%

E: Greater than or equal to 100%

<Seizure Resistance>

A seizure load was observed under the conditions specified in ASTM D3233-A using the Falex test method. A larger value of the seizure load indicates that seizure does not occur even in a case where a high load is applied, which is an excellent performance. Standardization was done by using a seizure load of Comparative Example 1-1 as a standard, and evaluation was performed as described below. An acceptance standard was a case of being evaluated as B or higher.

A: Seizure load is greater than or equal to twice with respect to the standard

B: Seizure load is greater than or equal to 1.7 times and less than 2 times, with respect to the standard C: Seizure load is greater than or equal to 1.5 times and less than 1.7 times, with respect to the standard D: Seizure load is greater than or equal to 1.3 times and less than 1.5 times, with respect to the standard E: Seizure load is less than 1.3 times with respect to the standard <Abrasion Resistance>

An abrasion test was carried out in the same manner as the conditions specified in ASTM D 4172 except that the four-ball test method was used and the test temperature was set to 100° C. After the test, abrasion scar diameters of the lower test balls were measured and an average thereof was calculated. A smaller calculated value (average of abrasion scar diameters) indicates that less abrasion occurs, which is an excellent performance.

Standardization was done by using a value of Comparative Example 1-1 as a standard, and evaluation was performed as described below. An acceptance standard was a case of being evaluated as C or higher.

A: Average of abrasion scar diameters is less than 50% with respect to the standard B: Average of abrasion scar diameters is greater than or equal to 50% and less than 60%, with respect to the standard C: Average of abrasion scar diameters is greater than or equal to 60% and less than 70%, with respect to the standard D: Average of abrasion scar diameters is greater than or equal to 70% and less than 90%, with respect to the standard E: Average of abrasion scar diameters is greater than or equal to 90% with respect to the standard In Table 2, base oil A is Group III mineral oil (YUBASE 4 (kinematic viscosity at 100° C. of 4 $mm_2/s$), manufactured by SK Lubricants Co. Ltd), and base oil B is poly alpha olefin oil (Durasyn 164 having a kinematic viscosity at 100° C. of 4 $mm_2/s$), and base oil C is ester oil (Synative ES DITA having a kinematic viscosity at 100° C. of 5.2 mm/s), manufactured by BASF). In addition, X-1 is pentaerythritol trilignoceric acid ester (hydroxyl number 47), and X-2 is glycerol trioleic acid ester (hydroxyl number <1).

Examples 2-1 to 2-4 and Comparative Examples 2-1 to 2-4

The composite ester A and the compound B shown in Table 3 were mixed with base oil to prepare each of the lubricant compositions of Examples 2-1 to 2-4 and Comparative Examples 2-1 to 2-4. A friction coefficient, seizure resistance and abrasion resistance of such a lubricant composition were evaluated by the following method.

<Friction Coefficient>

Evaluation was performed in the same manner as in the group of Example 1 except that the test temperature was set to 100° C. and standardization was done by using a friction coefficient of Comparative Example 2-1 as a standard.

<Seizure Resistance>

Evaluation was performed by the same method as in the group of Example 1 except that standardization was done by using a seizure load of Comparative Example 2-1 as a standard.

TABLE 2

| | Composite ester A | | Compound B | | | | | | |
|---|---|---|---|---|---|---|---|---|---|
| | Compound | % by mass | Compound | Hydroxyl number (mgKOH/g) | % by mass | Base oil | Friction coefficient | Seizure resistance | Abrasion resistance |
| Example 1-1 | A-1 | 2 | B-1 | 315 | 0.5 | A | B | A | A |
| Example 1-2 | A-1 | 2 | B-2 | 304 | 0.5 | A | B | A | A |
| Example 1-3 | A-1 | 2 | B-3 | 410 | 0.5 | A | B | A | A |
| Example 1-4 | A-1 | 2 | B-4 | 245 | 0.5 | A | B | A | A |
| Example 1-5 | A-1 | 2 | B-5 | 209 | 0.5 | A | C | B | B |
| Example 1-6 | A-1 | 2 | B-6 | 169 | 0.5 | A | C | B | B |
| Example 1-7 | A-1 | 2 | B-7 | 60 | 0.5 | A | C | B | B |
| Example 1-8 | A-1 | 2 | B-8 | 90 | 0.5 | A | C | B | B |
| Example 1-9 | A-1 | 2 | B-9 | 82 | 0.5 | A | C | B | B |
| Example 1-10 | A-4 | 2 | B-1 | 315 | 0.5 | A | B | A | A |
| Example 1-11 | A-6 | 2 | B-1 | 315 | 0.5 | A | C | B | B |
| Example 1-12 | A-7 | 2 | B-1 | 315 | 0.5 | A | C | B | B |
| Example 1-13 | A-9 | 2 | B-1 | 315 | 0.5 | A | C | B | B |
| Example 1-14 | A-10 | 2 | B-1 | 315 | 0.5 | A | C | B | C |
| Example 1-15 | A-11 | 2 | B-1 | 315 | 0.5 | A | C | B | C |
| Example 1-16 | A-1 | 2 | B-1 | 315 | 0.1 | A | B | A | A |
| Example 1-17 | A-1 | 0.5 | B-1 | 315 | 0.5 | A | B | A | A |
| Example 1-18 | A-1 | 2 | B-1 | 315 | 0.5 | B | B | A | A |
| Example 1-19 | A-1 | 2 | B-1 | 315 | 0.5 | C | B | A | A |
| Example 1-20 | A-1 | 2 | B-10 | 434 | 0.5 | A | C | B | B |
| Comparative Example 1-1 | Absent | — | Absent | — | — | A | E (standard) | E (standard) | E (standard) |
| Comparative Example 1-2 | A-1 | 2 | Absent | — | — | A | E | D | D |
| Comparative Example 1-3 | Absent | — | B-1 | 315 | 0.5 | A | D | D | D |
| Comparative Example 1-4 | A-1 | 2 | X-1 | 47 | 0.5 | A | D | D | D |
| Comparative Example 1-5 | A-1 | 2 | X-2 | <1 | 0.5 | A | D | D | E |

<Abrasion Resistance>

Evaluation was performed by the same method as in the group of Example 1 except that the test temperature was set to 100° C. and standardization was done by using an abrasion scar diameter of Comparative Example 2-1 as a standard.

TABLE 3

| | Composite ester A | | Compound B | | | | | | |
|---|---|---|---|---|---|---|---|---|---|
| | Compound | % by mass | Compound | Hydroxyl number (mgKOH/g) | % by mass | Base oil | Friction coefficient | Seizure resistance | Abrasion resistance |
| Example 2-1 | A-1 | 2 | B-1 | 315 | 0.5 | D | A | A | A |
| Example 2-2 | A-1 | 2 | B-5 | 209 | 0.5 | D | A | B | B |
| Example 2-3 | A-1 | 2 | B-6 | 169 | 0.5 | D | B | B | B |
| Example 2-4 | A-1 | 2 | B-9 | 82 | 0.5 | D | C | B | B |
| Comparative Example 2-1 | Absent | — | Absent | — | — | D | E (standard) | E (standard) | E (standard) |
| Comparative Example 2-2 | A-1 | 2 | Absent | — | — | D | D | C | D |
| Comparative Example 2-3 | Absent | — | B-1 | 315 | 0.5 | D | E | D | C |
| Comparative Example 2-4 | A-1 | 2 | X-1 | 47 | 0.5 | D | D | C | D |

In Table 3, base oil D was base oil obtained by adding, to Group III mineral oil (YUBASE 4 (kinematic viscosity at 100° C. of 4 $mm_2/s$), manufactured by SK lubricants Co., LTD.), ZnDTP and MoDTC so that a zinc content of 900 mg/kg and a Mo content of 800 mg/kg are achieved, respectively, and further adding thereto 5% by mass of calcium sulfonate with respect to the total mass of the base oil D.

What is claimed is:

1. A manufacturing method of a lubricant composition, comprising:

mixing a composite ester A that contains polyester obtained by condensing trihydric or more polyhydric alcohol a1, a divalent or more polyvalent carboxylic acid a2, and monohydric alcohol a3 having an oxyalkylene structure, with a compound B represented by any one of General Formulae 1 to 3 and having a hydroxyl number of greater than 50 mgKOH/g, General Formula 1

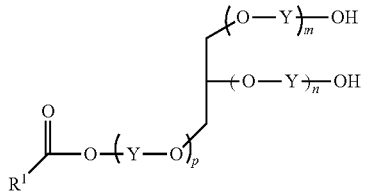

General Formula 2

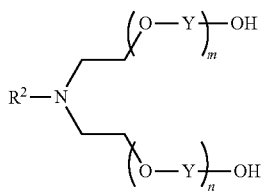

-continued

General Formula 3

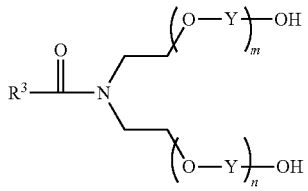

wherein in General Formulae 1 to 3, $R^1$ to $R^3$ each independently represent a hydrocarbon group having 4 to 30 carbon atoms; Y represents an alkylene group having 2 to 4 carbon atoms, and, in a case where a plurality of Y's are present in one molecule, the plurality of Y's may be the same or different from each other; and m, n, and p each independently represent an integer of 0 to 20.

2. The manufacturing method of a lubricant composition according to claim 1, wherein the polyvalent carboxylic acid a2 is a polyvalent carboxylic acid having greater than or equal to 36 carbon atoms.

3. The manufacturing method of a lubricant composition according to claim 1, further comprising:

adding a compound that contains at least one atom selected from the group consisting of molybdenum, zinc, phosphorus, and sulfur.

4. The manufacturing method of a lubricant composition according to claim 1, wherein the composite ester A and the compound B are mixed so that a mass ratio of the composite ester A to the compound B is 100:1 to 1:50.

5. The manufacturing method of a lubricant composition according to claim 1, wherein the compound B has a hydroxyl number of greater than 100 mgKOH/g.

6. The manufacturing method of a lubricant composition according to claim 1, wherein in the General Formulae 1 to 3, Y represents an alkylene group having 2 to 4 carbon atoms, and m and n each independently represent an integer of 0 to 5.

7. A lubricant composition, comprising:

a composite ester A that contains polyester obtained by condensing trihydric or more polyhydric alcohol a1, a divalent or more polyvalent carboxylic acid a2, and monohydric alcohol a3 having an oxyalkylene structure; and a compound B represented by any one of General Formulae 1 to 3 and having a hydroxyl number of greater than 50 mgKOH/g, General Formula 1

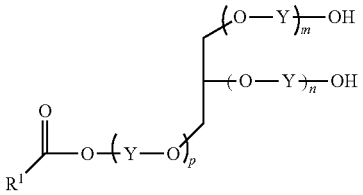

General Formula 2

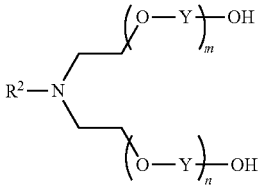

-continued

General Formula 3

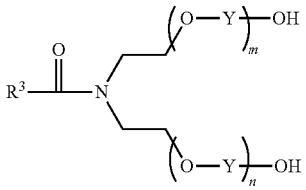

wherein in General Formulae 1 to 3, $R^1$ to $R^3$ each independently represent a hydrocarbon group having 4 to 30 carbon atoms; Y represents an alkylene group having 2 to 4 carbon atoms, and, in a case where a plurality of Y's are present in one molecule, the plurality of Y's may be the same or different from each other; and m, n, and p each independently represent an integer of 0 to 20.

8. The lubricant composition according to claim 7, wherein the polyvalent carboxylic acid a2 is a polyvalent carboxylic acid having greater than or equal to 36 carbon atoms.

9. The lubricant composition according to claim 7, further comprising:

a compound that contains at least one atom selected from the group consisting of molybdenum, zinc, phosphorus, and sulfur.

10. The lubricant composition according to claim 7, wherein the compound B has a molecular weight of less than or equal to 1,000.

11. The lubricant composition according to claim 7, wherein a mass ratio of the composite ester A to the compound B is 100:1 to 1:50.

12. The lubricant composition according to claim 7, wherein in General Formulae 1 to 3, Y represents an alkylene group having 2 to 4 carbon atoms, and m and n each independently represent an integer of 0 to 5.

* * * * *